US006640703B2

(12) United States Patent
Fukumori et al.

(10) Patent No.: US 6,640,703 B2
(45) Date of Patent: Nov. 4, 2003

(54) GRAVURE PRINTING METHOD USING AQUATIC GRAVURE INK AND GRAVURE PRINTING MACHINE FOR THE SAME

(75) Inventors: Hirotsugu Fukumori, Yokohama (JP); Michiyoshi Shimizu, Seto (JP); Toshiyuki Torasawa, Kasugai (JP); Katsumi Nakaya, Komaki (JP); Kimio Sugiyama, Nagoya (JP)

(73) Assignee: Japan Patent Management Co., Ltd., Tokyo (JP)

( * ) Notice: Subject to any disclaimer, the term of this patent is extended or adjusted under 35 U.S.C. 154(b) by 0 days.

(21) Appl. No.: 10/014,613

(22) Filed: Nov. 7, 2001

(65) Prior Publication Data

US 2002/0059876 A1 May 23, 2002

Related U.S. Application Data

(62) Division of application No. 09/626,131, filed on Jul. 26, 2000, now Pat. No. 6,401,609.

(30) Foreign Application Priority Data

| | | |
|---|---|---|
| Jul. 27, 1999 | (JP) | 11-211532 |
| Sep. 3, 1999 | (JP) | 11-250423 |
| Jan. 24, 2000 | (JP) | 2000-014712 |
| Apr. 7, 2000 | (JP) | 2000-106154 |

(51) Int. Cl.[7] ..... B41F 9/00

(52) U.S. Cl. ..... 101/153; 101/157; 101/350.6; 101/367

(58) Field of Search ..... 101/153, 157, 101/169, 350.1, 350.6, 352.01, 350.5, 362–367

(56) References Cited

U.S. PATENT DOCUMENTS

| | | | | |
|---|---|---|---|---|
| 2,295,857 A | * | 9/1942 | McConnell | 101/153 |
| 5,103,723 A | * | 4/1992 | Maier | 101/153 |
| 5,381,733 A | * | 1/1995 | Hirashima | 101/157 |
| 5,497,700 A | * | 3/1996 | Herb | 101/157 |
| 5,638,751 A | * | 6/1997 | Daetwyler et al. | 101/169 |
| 5,694,850 A | * | 12/1997 | Pickard | 101/157 |
| 5,749,293 A | * | 5/1998 | Ota et al. | 101/157 |
| 6,108,508 A | * | 8/2000 | Takeuchi et al. | 101/367 |
| 6,283,023 B1 | * | 9/2001 | Christmann et al. | 101/153 |

FOREIGN PATENT DOCUMENTS

| | | |
|---|---|---|
| DE | 3221144 | * 12/1983 |
| JP | 35-6169069 | * 12/1981 |

* cited by examiner

*Primary Examiner*—Eugene H. Eickholt
(74) *Attorney, Agent, or Firm*—McGlew and Tuttle, P.C.

(57) ABSTRACT

A gravure printing method is provided for printing characters or patterns with desired colors and tones on a base material with a printing drum set with 200 to 400 mesh lines and the depth in the range from 10 to 17$\mu$. The ink may be process color of aquatic gravure ink in which coloring materials for indigo blue, red, yellow, black, and white colors are printed once or repeatedly in the overlaid state or specially toned inks. Another aspect of the invention provides an ink pan structure and arrangement for a gravure printing machines using aquatic or oil gravure ink. The ink pan structure has an ink pool sized for only a furnisher roll to be dipped therein and a cooperating printing drum is always maintained outside the ink pool. A furnisher roller unit and arrangement for a gravure printing machine is also provided. The unit may include a plurality of furnisher rollers. A doctor knife unit and arrangement for a gravure printing machine is also provided. The unit may include a plurality of doctor knives.

12 Claims, 7 Drawing Sheets

GRAVURE PRINTING METHOD USING AQUATIC GRAVURE INK AND GRAVURE PRINTING MACHINE FOR THE SAME

This is a Divisional of application Ser. No. 09/626,131 filed Jul. 26, 2000, now U.S. Pat. No. 6,401,609 and the entire disclosure of this prior application is considered to be part of the disclosure of the accompanying application and is hereby incorporated by reference therein.

FIELD OF THE INVENTION

The present invention relates to a gravure printing method using aquatic gravure ink and a printing drum, print material, and equipment such as an ink pan, a furnisher roll, and a doctor knife used for carrying out the method.

BACKGROUND OF THE INVENTION

Conventionally an organic solvent type of (oil) ink has been used in the gravure printing, and for color matching, printing is performed once or repeatedly in the overlaid state using process color ink in which coloring materials for indigo blue, red, yellow, black and white colors are included. When a specific color is required by a customer, toning is performed to satisfy the customer's request. If a large quantity of ink with any specific color is required, a printing firm purchases the ink already toned, by an ink manufacturer, from the supplier. Because of the characteristics of the organic solvent type of ink, to satisfy a customer's requests for coloring performance and gradation, generally a low-mesh (with about 175 lines) and deep (with the depth of 18 to 30$\mu$) printing plate is used.

For the reasons described above, the problems as described below occur in the gravure printing method using the organic solvent type of gravure ink.

1) As the ink is of an organic solvent type, problems occur concerning the working environment in the printing firms, accident prevention, contamination of the environment due to the emission of the gasified solvent to atmosphere. Further, there is the problem of residual solvents, when the material printed with the ink is used as a film for food packaging.

2) When the organic solvent type of ink is used, as the ink dries fast and the gradation in printing is narrow, a deep and low-mesh printing plate is used as described above. In this case a large quantity of ink is consumed. This is a main cause for cost increase in printing.

3) In the conventional gravure printing, printing with the process color ink as described above is performed once or repeatedly, and further as ink with a specific color (required by a customer) is used in many cases, a number of colors and the number of printing plates increase. This results in a time loss due to preparatory steps before the start of printing and a toning loss. Further in a case of ink with a specific color, as the ink can not be used for other purposes, the quantity of left over remaining ink increases. This negatively effects printing cost. Sometimes the remaining ink is discarded, so that improvements are required also from the view point of resource saving.

4) Recently customers in the market require various types of print materials with a small lot to be produced and in addition within a short period of time. With this, the needs for cost management are becoming more and more stringent. Further social attention is more and more concentrated on the problems concerning environmental pollution and sanitary management in food industries. When organic solvent types of ink are used, the social needs cannot be satisfied.

For the reasons described above, a printing method using aquatic gravure ink in place of the organic solvent type of ink is being considered with keen interest. Further, different from the oil gravure ink conventionally used in the art, the aquatic gravure ink insures substantial improvement in the working environment in the printing firms. Because of this feature, it can be expected that the aquatic gravure ink will be used more and more in gravure printing.

When the aquatic gravure ink is used, the problems caused in association with use of organic solvents do not occur. However, aquatic ink has by its nature such deficiencies including the hardness in drying, hardness in resolving in the water solvent, and hardness in wetting a printing plate surface due to the surface tension. When the type board is set by the same technique as that with the organic solvent type of ink currently available in the market, the printing speed becomes lower. In addition such problems as fogging or gradation fault occur on the printing plate, which makes it impossible to obtain high quantity print materials.

2. In the conventional type of gravure printing machine, the size of the ink pan 1 is very large as shown in FIG. 5, a large quantity of remaining ink is left in the ink pan 1 (about 20 kg per printing plate). When the ink is the standard color, the ink can be used the next time. However, if the ink is a specific color based on the customer's request, it is necessary to stock the ink until the ink is used the next time. This results in substantial a cost increase.

Especially, when structure of a printing machine using aquatic gravure ink is as described above, due to fogging on the type board caused by hardness of the ink in resolving in a water solvent as an intrinsic defect of aquatic gravure ink, the remaining ink can not be used again, which causes a grave problem in cost management.

In FIG. 5, designated at the reference numeral 2 is a furnisher roll, at 3 is a printing drum, at 3*a* is a printing plate surface, at 5 is a doctor blade, at 6 is a pressure drum, and at 7 is a film.

In the conventional type of gravure printing machine, the furnisher roll 2 is provided in the side opposite to the doctor as shown in FIG. 6. Because of this configuration, when gravure printing is carried out with aquatic gravure ink, wetting failure as an intrinsic defect of the aquatic gravure ink occurs due to the surface tension on a surface of the printing plate, so that, as the printing speed becomes faster, ink on the printing plate drops into the ink pan 1, which causes blurring on print materials or fogging on the printing plate surface and disadvantageously makes it difficult to perform printing under good conditions.

Further in the conventional doctor knife of gravure printing machine, the length L of a back plate 5*b* projecting from a bracket 5*a* of the doctor blade 5 is set to 30 m/m as shown in FIG. 7 and FIG. 8, and the length L1 of a blade tip of a doctor knife 5*c* is set to 4 m/m, so that, because of the dimensions, the excellent coloring performance to and gradation on a base film are insured when the printing ink is oil ink.

However, when printing is performed with aquatic gravure ink under the same conditions as those employed when printing is performed with oil gravure ink, fogging occurs on a surface of the printing plate due to the doctor cutting fault caused in association with the hardness of the ink in resolving in a water solvent as an intrinsic defect of the aquatic gravure ink, and there occurs the problem that printing cannot be carried out without changing structure of the doctor.

3. In the gravure printing machine using oil ink, as shown in FIG. 11, the furnisher roll 2 is provided against the printing drum 3 in the side opposite to the doctor knife 5, and ink 4 in the ink pan 1 is pumped up by the single furnisher roll 2 and supplied onto the printing plate surface 3*a*. In FIG. 11, designated at the reference numeral 6 is a pressure drum, and at 7 is a printed film.

When gravure printing is performed using the aquatic gravure ink, if the conventional structure is unchanged, wetting failure of ink 4 occurs on the printing plate surface 3*a* due to the surface tension as an intrinsic defect of the aquatic ink, and as the printing speed becomes faster, the ink 4 supplied onto the printing plate surface 3*a* drops into the ink pan 1, and as the result, blurring on print materials and fogging on the printing plate occur, which disadvantageously makes it impossible to perform printing under good conditions.

When gravure printing is performed using the oil gravure ink, the problem described above does not occur, but such problems as blocking occur when the printing plate surface 3*a* is dried after the ink is transferred onto the film 7, and to prevent this phenomenon, it is necessary to pump up the ink 4 from the ink pan 1 as fast as possible, and to satisfy this necessity, the furnisher roll 2 is provided in the opposite side from the knife edge 5. When the printing drum 3 is rotated at a faster speed, the ink 4 drops or scatters from the surface 3*a* of the printing drum 3 due to the centrifugal force and weight of the ink 4, so that there is a limit to increasing the rotating speed of the printing drum 3 even when the oil gravure ink is used.

4. In the gravure printing machine using oil ink, ink 4 in the ink pan 1 is pumped up by the furnisher roll 2, and surplus ink transferred onto the printing drum 3 is scraped off by the single doctor knife 5 to form the excellent printing plate surface 3*a* as shown in FIG. 14. With this, good prints are obtained on the base film 7 via the pressure drum 6.

The blade tip 5*c* of the doctor knife 5 is generally supported by the back plate 5*b* and clamped or fixed with the bracket 5*a* as shown in FIG. 15.

When gravure printing is carried out using aquatic gravure ink and with the conventional type of doctor knife 5 having the structure as described above, the wetting failure of the printing plate surface 3*a* occurs, caused by large surface tension and the doctor cutting fault due to precipitation of not-resolved materials onto the printing plate surface 3*a* because of the hardness of the aquatic ink in resolving in a water solvent. Blurring on print materials or "fogging on the printing plate" is generated, which disadvantageously makes it difficult to carry out printing under good conditions.

Especially when black ink (with carbon contained therein) or white ink (containing titanium white) is used in printing, the remarkable defect of precipitation of not-resolved materials as described above is generated.

When a doctor pressure to the printing drum 3 is made larger to solve the problems described above, the effect is maintained within a short period of time, but as the doctor knife wears out quickly, so that sharpness in cutting with the doctor knife deteriorates, "printing plate fogging" occurs. This makes it impossible to continue the printing job for a long period of time, and in addition, the type set on the printing plate surface 3*a* becomes worn out. Disadvantageously, a new gravure cylinder is required.

Therefore, and as the final means for solving the problems as described above, when printing is performed with aquatic gravure ink and with the conventional type of doctor knife, the way to continue the printing job is by lowering the printing speed.

SUMMARY AND OBJECTS OF THE INVENTION

It is a first object of the present invention to provide an aquatic gravure printing method capable of providing high quality aquatic gravure prints by solving the problems of printing plate fogging or gradation faults generated when printing is performed with aquatic gravure ink, and to provide a printing drum used for carrying out the method, and to provide prints printed by the method.

It is a second object of the present invention to enable reduction of ink cost by reducing a quantity of remaining ink as much as possible in an ink pan of a gravure printing machine using aquatic or oil gravure ink.

It is a third object of the present invention to provide a furnisher roll not causing wetting failure even when rotated at a high speed in a gravure printing machine using aquatic ink.

It is a fourth object of the present invention to provide a doctor blade or doctor knife which does not cause fogging on a printing plate in a gravure printing machine using aquatic gravure ink.

It is a fifth object of the present invention to provide a furnisher roller to solve the problems of "blurring" or "fogging on a printing plate" due to wetting failure in gravure printing carried out by using aquatic gravure ink.

It is a sixth object of the present invention to provide a furnisher roll to enable running of an oil gravure printing machine at a higher speed as compared to that based on the conventional technology.

It is a seventh object of the present invention to provide a doctor knife unit which will neither cause "blurring" on print material nor "fogging on a printing plate" due to a doctor knife cutting fault due to wetting failure or hardness in resolving.

According to the invention, a gravure printing method is provided for printing characters or patterns with desired colors and tones on a base material with a printing drum set with 200 to 400 mesh lines and the depth in the range from 10 to 17$\mu$ and by using process color of aquatic gravure ink in which coloring materials for indigo blue, red, yellow, black, and white colors are printed once or repeatedly in the overlaid state.

According to another aspect of the invention, an ink pan structure and arrangement for a gravure printing machines using aquatic or oil gravure ink is provided. The ink pan structure has an ink pool sized for only a furnisher roll to be dipped therein and a cooperating printing drum is always maintained outside the ink pool.

According to another aspect of the invention, a furnisher roller unit and arrangement for a gravure printing machine is provided. The unit includes a plurality of furnisher rollers.

According to another aspect of the invention, a doctor knife unit and arrangement for a gravure printing machine is provided. The unit includes a plurality of doctor knives.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
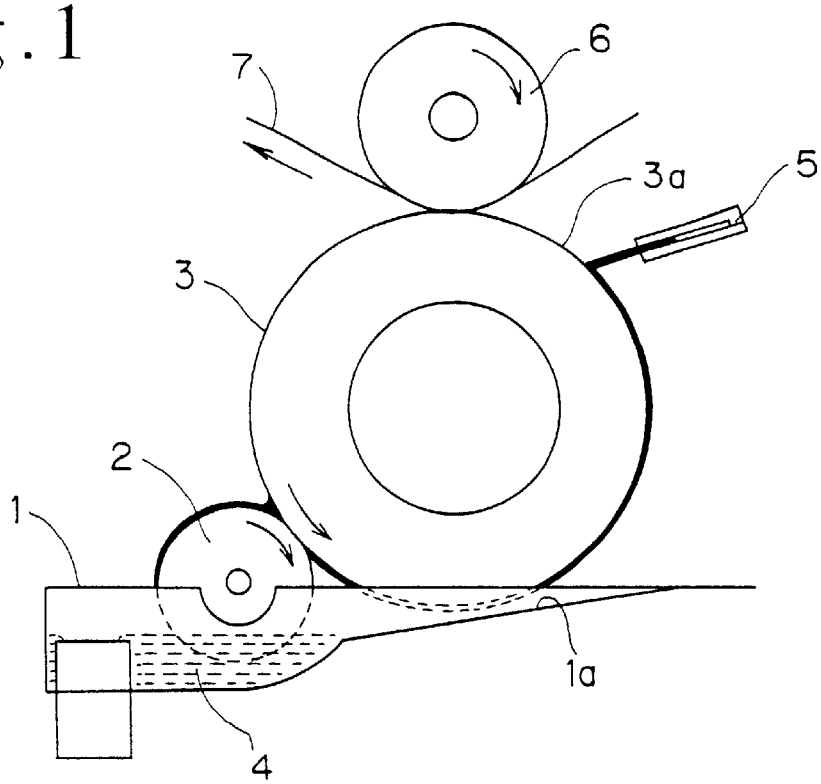
FIG. 1 is an explanatory view showing a gravure printing machine using aquatic and oil gravure inks according to the third embodiment of the present invention configured so that a quantity of remaining ink is substantially reduced by minimizing an ink pool in an ink pan.

Referring to the drawings in particular, aquatic gravure ink is generally process color ink in which coloring materials for indigo blue, red, yellow, black, and white colors are included, and printing is basically performed with the process color ink once or repeatedly in the overlaid state to obtain desired colors and tone. The process color ink, in which coloring materials for these five colors are mixed, contain resins for aquatic ink as main components. This is adjusted by adding pigments and necessary additive(s) and solving the mixture in water or in a solvent comprising water, alcohol, and the like.

The technique for making a gravure cylinder is important in the gravure printing method using aquatic gravure ink. With the conventional type of printing plate (a low-mesh and deep one with about 175 lines and the depth in the range from 18 to 30 $\mu$), such failures as blocking on the printing plate, fouling of the printing drum, appearance of the doctor line, logging on a surface of the printing plate, and gradation fault frequently occur during printing even if aquatic gravure ink is used, so that the industrial needs are not satisfied, but when a printing plate with 200 to 400 lines, preferably 350 lines and the depth in the range from 17to 10$\mu$, and preferably in the range from 12 to 13$\mu$ is used, all of the problems which occur when the conventional printing plate as described above is used are solved. This is true for any type of printing plate.

With the low-mesh printing plate with 200 lines or below, as the aquatic ink does not dry fast, blurring occurs at dots on the film, which makes it impossible to obtain high quality prints.

When the number of lines is 400 or more, a bank surrounding a cell on a gravure printing plate (intaglio plate) is cut, and a dot on aquatic ink film is not formed, which disables printing. In addition, dots on the film become smaller, so that the tone width becomes narrower, which also makes it impossible to obtain high quality prints.

When the depth is 17$\mu$ or more, blocking occurs on the printing plate because of the hardness of aquatic ink in resolving in an aqueous solution. In addition, due to the hardness of aquatic ink in drying, characters or color tones are not clear, so that printed matters with desired quality cannot be obtained. Further, a quantity of used ink increases, so that such problems as cost increase occur.

When the depth of engraving on a printing plate is 10$\mu$ or less, unevenness is generated on a surface of the printing plate, so that also printed tones are not even and printed matters with desired quality can not be obtained. Further the ink film is thin, so that there are problems such as the difficulty in obtaining desired color density occur.

The description above assumes a case where printing with process color inks is executed once or repeatedly in the overlaid state, but aquatic gravure ink with adjusted tone and specified color may be used in combination with the process colors in a portion of a printed matter or on the entire printed matter, and the making of the gravure cylinder is performed in the same way also when the aquatic gravure ink with adjusted tone or specified color is used.

Embodiment 1

By using the bi-axial oriented polypropylene film 20$\mu$ as a base material, aquatic ink available from the market, and a diluted solvent in which water, ethanol, and isopropyl alcohol are mixed at the ratio of 50/30/20%, printing ink with the viscosity of Zahn cup #3-16 sec in which coloring materials for indigo blue, red, yellow, black, white, and other two specific colors are mixed was prepared, a printing plate with 350 lines and the depth of 13$\mu$ was set by means of a laser system, and gravure printing was carried out with 7 colors and 7 printing plates. As the result, defects caused by fogging on the printing plate or the like were not found on the obtained prints, and high-quality prints are obtained.

Control 1

By using the bi-axial oriented polyester film 12$\mu$ as a base material, aquatic ink available from the market, and a diluted solvent in which water, ethanol, and isopropyl alcohol are mixed at the ratio of 50/30/20%, printing ink with the viscosity of Zahn cup #3-16 sec in which coloring materials for indigo blue, red, yellow, black, white, and other two specific colors are mixed was prepared, a printing plate with 175 lines and the depth of 18$\mu$ was set by means of a laser system, and printing was performed with the printing plate. In this case, as the ink was aquatic and the depth of engraving was deep, the printing speed was low (70 m/min) because of the hardness in drying, and further as the mesh of the printing plate was rough, good color gradation could not be obtained, and as aquatic ink is by its nature harder in resolving in a water solvent and has larger surface tension as compared to oil ink. Problems such as fogging on the printing plate occur, and prints with desired quality cannot be obtained.

Embodiment 2

By using the bi-axial oriented nylon film 15$\mu$ as a base material, toned aquatic ink with a specified color, and a diluted solvent in which water, ethanol, and isopropyl alcohol are mixed at the ratio of 50/30/20%, printing ink with the viscosity of Zahn cup #3-16 sec was prepared, and printing was performed with the printing ink described above using a printing plate with 350 lines and the depth of 13$\mu$ set by a laser system. As the result, such failures as fogging on the printing plate were not observed, and high quality prints with the specified color were obtained. In addition the color gradation and reproducibility of thin characters were excellent.

Control 2

By using the bi-axial oriented nylon film 15$\mu$ as a base material, toned aquatic ink with a specified color, and a diluted solvent in which water, ethanol, and isopropyl alcohol are mixed at the ratio of 50/30/20%, printing ink with the viscosity of Zahn cup #3-16 sec was prepared, printing was performed with the printing ink using a printing plate with 175 lines and the depth of 18$\mu$ set by a laser system. As the result, such failures as fogging on the printing plate occurred, and a printed matter with the desired quality could not be obtained.

From the Embodiments 1, 2 and Controls 1, 2 described in detail above, it is understood that practical gravure printing in which such failures as fogging on a printing plate do not occur can be performed by specifying particular conditions in the technology for making gravure cylinder.

Embodiment 3

This Embodiment relates to the structure of an ink pan according to the invention of claim 6, and the Embodiment is described in detail below with reference to FIG. 1. FIG. 1 is a side view of a key section of a gravure printing machine comprising a printing drum, an ink pan in which gravure ink for printing is stored, a furnisher roller for transferring and applying the printing ink stored in the ink pan onto a surface of the printing drum, a doctor blade for scraping off surplus ink from the printing plate surface by contacting the blade tip thereto, and a pressure drum for pressing film onto the surface of the printing drum.

In FIG. 1, the reference numeral 1 indicates an ink pan, and the ink pan 1 in this Embodiment has an ink pool 4 formed with a deep bottom in a section where the furnisher roller 2 is positioned. The section where the printing drum 3 is positioned is formed with a shallow bottom 1*a* having the depth enough to receive ink dropped from the printing drum 3, and this shallow bottom 1*a* is downwardly inclined toward the ink pool 4 so that the printing ink is not pooled on the shallow bottom 1*a*.

In the ink pan 1 in this Embodiment, the printing ink is always pooled only in the ink pool 4, and the ink is applied onto a surface 3*a* of the printing drum 3 via the furnisher roller 2, then only the surplus ink is scraped off by the doctor 5 from the printing plate surface, and the printing drum is used for printing.

Embodiment 4

This embodiment relates to the structure of a furnisher roller according to the invention.

Figure 2:
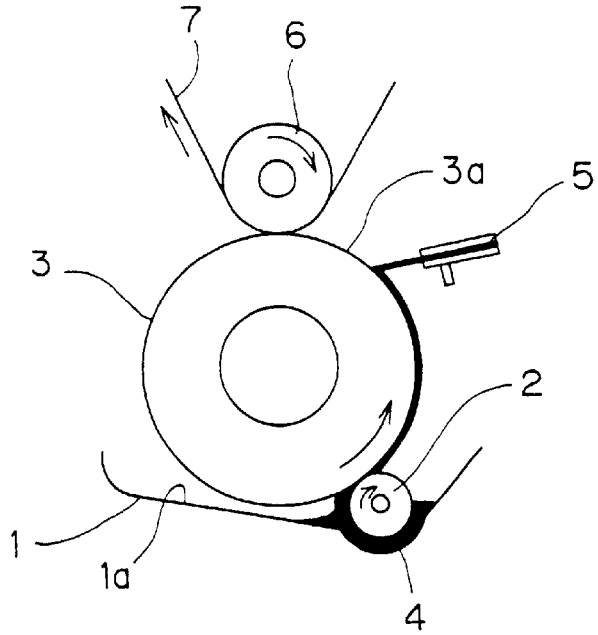
FIG. 2 is an explanatory view showing a gravure printing machine using aquatic gravure ink according to the fourth embodiment of the present invention configured so that generation of wetting failure is prevented by changing a position of the furnisher roller to the side of a doctor blade.

The furnisher roller is described in detail below with reference to FIG. 2. FIG. 2 is a side view of a key section of the gravure printing machine comprising a printing drum, an ink pan in which printing ink is stored, a furnisher roller for transferring and applying the printing ink from this ink pan onto a surface of the printing drum, a doctor for scraping off surplus ink from the printing plate surface by contacting the blade tip thereto, and a pressure drum for pressing film to the printing plate surface.

In FIG. 2, the reference numeral 1 indicates an ink pan, and the ink pan 1 in this embodiment has the ink pool 4 formed in the side where the doctor 5 is positioned, and also the furnisher roller 2 for applying the printing ink from this ink pool 4 onto the surface 3*a* of the printing drum 3 is positioned in the side where the doctor 5 is positioned.

As the furnisher roller 2 in this embodiment is provided in the side where the doctor 5 is positioned, an upward centrifugal force is loaded to the ink applied from the furnisher roller 2 onto the surface 3*a* of the printing drum 3, so that, when aquatic gravure ink with larger surface tension is used and printing is performed at a high speed, the printing ink does not drop into the side where the ink pan 1 is located and wetting failure does not occur.

Embodiment 5

Figure 3:
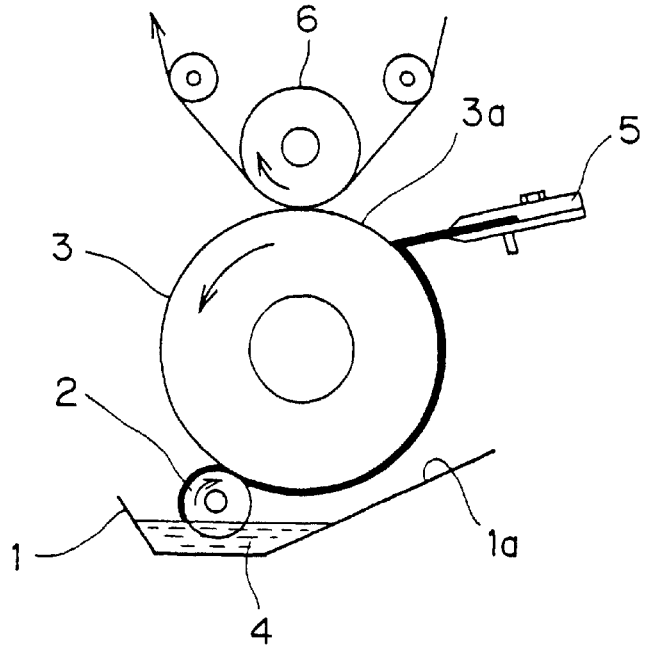
FIG. 3 is an explanatory view showing a gravure printing machine using aquatic gravure ink according to the fifth embodiment of the present invention configured so that generation of fogging on a surface of a printing plate due to an inappropriate contact pressure of the doctor element is prevented.

This embodiment relates to the structure of a doctor according to the invention of. The details are described below with reference to FIG. 3 and FIG. 4. FIG. 3 is a side view of a key section of a gravure printing machine comprising an ink pan in which printing ink is stored, a furnisher roller for applying the printing ink from this ink pan onto a surface of a printing drum, a doctor for scraping off surplus ink from the printing plate surface by contacting the blade tip thereto, and a pressure drum for pressing film onto the printing plate surface.

In FIG. 3, the reference numeral 1 indicates an ink pan, and the ink pan 1 in this embodiment has the ink pool 4 with a deep depth formed in the section where the furnisher roller 2 is positioned, a shallow bottom 1*a* with the depth enough to receive printing ink dropped from the printing drum 3 is formed in the side where the printing drum 3 is positioned, and this shallow bottom 1*a* is downwardly inclined toward the ink pool 4, so that the printing ink is not pooled in this shallow bottom section 1*a*.

Figure 4:
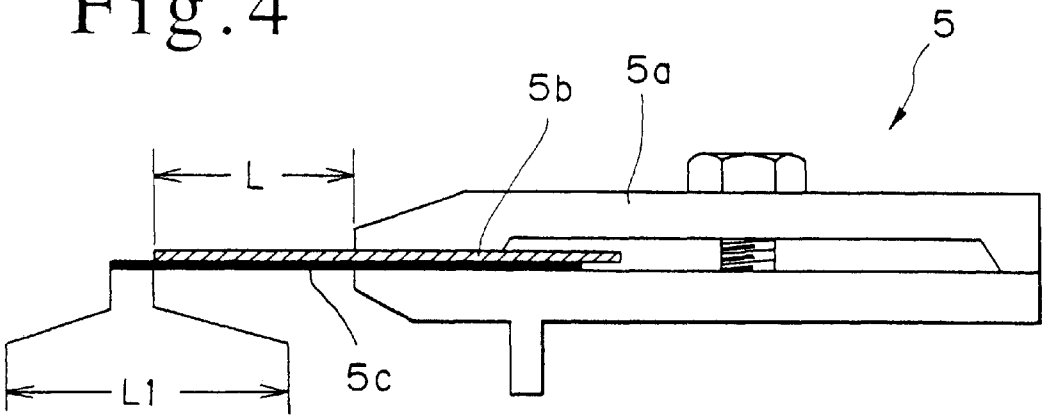
FIG. 4 is an explanatory view showing details of structure of the doctor blade according to the fifth embodiment of the present invention.
Figure 5:
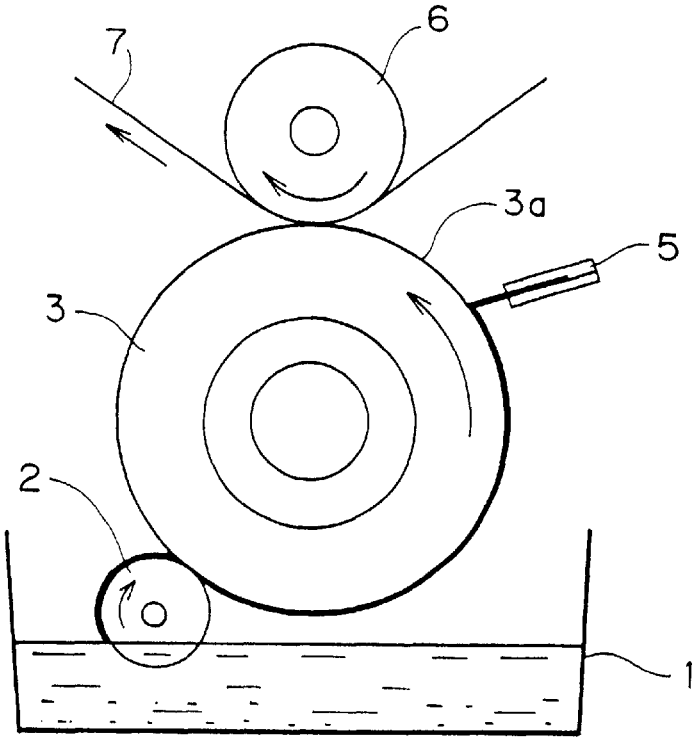
FIG. 5 is an explanatory view for the conventional type of ink pan.
Figure 6:
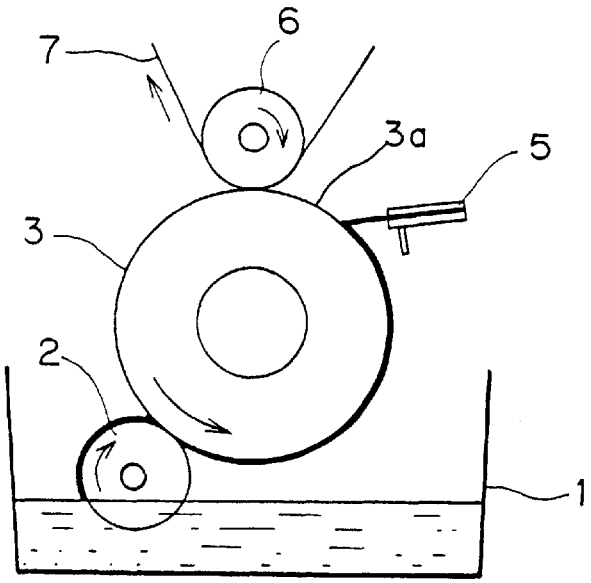
FIG. 6 is an explanatory view showing a position of the conventional type of furnisher roller.
Figure 7:
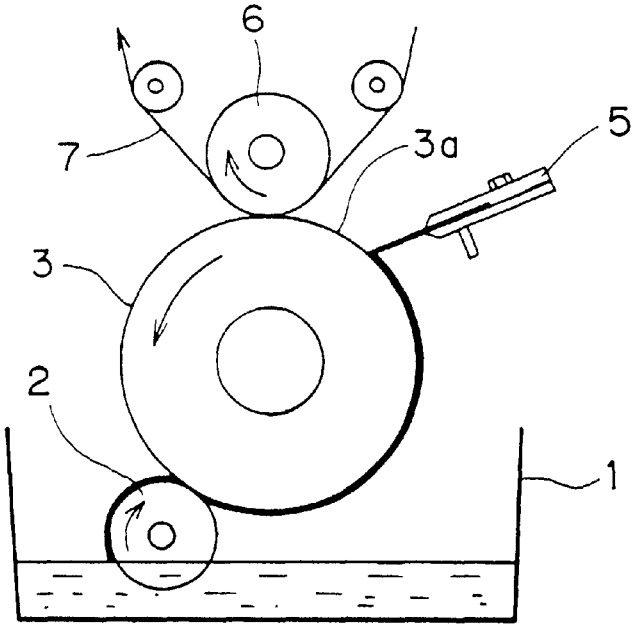
FIG. 7 is an explanatory view showing a key section of and a doctor blade in the conventional type of gravure printing machine.

The reference numeral 5 indicates a doctor, and in the doctor 5 in this embodiment, the length L of a back plate 5*b* projecting from a bracket 5*a* as shown in FIG. 4 is 25 m/m, and the length L1 of a blade tip of a doctor knife 5*c* projecting from a tip of this back plate 5*b* is 3.5 m/m.

In this doctor 5, when the length L of the back plate 5*b* is 27 m/m or more, a blade tip of the doctor knife 5*c* does not work well for scraping off the printing ink, and on the contrary when the length L is 22 m/m or below, a force loaded by the doctor knife 5 is excessive and such bad effects as friction occur on the print plate surface 3*a*, so that the length L of the back plate 5*b* should be set in the range from 22 m/m to 27 m/m, and the optimal length L is 25 m/m.

When the length L1 of a blade tip of the doctor knife 5*c* is 3.7 m/m or more, the doctor knife 5*c* can not scrape off the printing ink sufficiently, and when the length L1 is less than 3.2 m/m, such bad effects as friction occur on the printing plate surface 3*a,* so that the length L1 should be set in the range from 3.2 m/m to 3.7 m/m, and the optimal length L1 is 3.5 m/m.

Control 3

Figure 8:
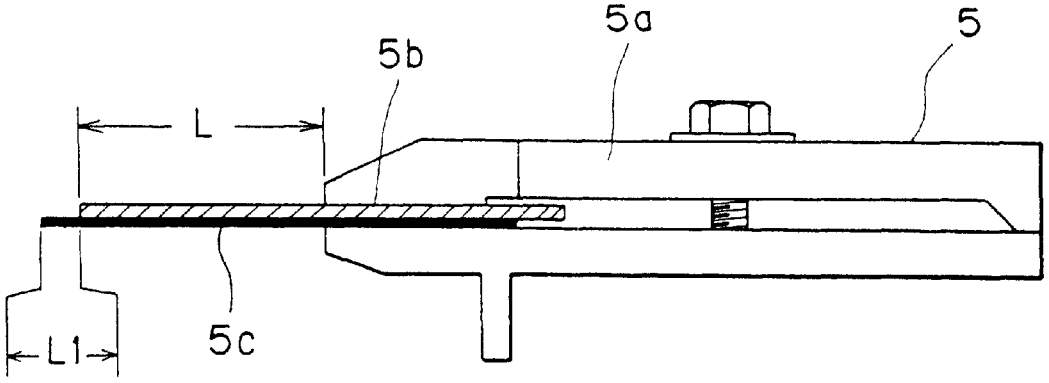
FIG. 8 is an explanatory view showing details of structure of the conventional type of doctor blade.

A control against the doctor 5 in Embodiment 5 is described below. In the doctor as an object for comparison, the length L of the back plate 5*b* shown in FIG. 8 is 35 m/m, the blade length L1 of the doctor knife 5*c* is 6.5 m/m, and this doctor is for oil ink.

By using bi-axial oriented nylon film 15$\mu$ as a base material, a printing plate with 350 lines and the depth of 13$\mu$ was prepared by a laser system. Printing for 6 colors was performed with five printing plates and aquatic gravure inks for indigo blues, red, yellow, black, and white colors available from the market, and this embodiment was compared to the embodiment of conventional technology shown in FIG. 8 in terms of dimensions of the doctor 5. In the latter case, fogging on the printing plate occurred due to the doctor cutting fault for all colors, and a high quality printing film could not be obtained, but in the former case, namely in the case of the doctor 5 according to the present invention, the doctor blade functioned well in scraping off inks for all of the colors with fogging not generated on the printing plate at all, and a high quality printing film could be obtained.

Embodiment 6

An embodiment of the invention is described in detail below with reference to FIG. 9.

Figure 9:
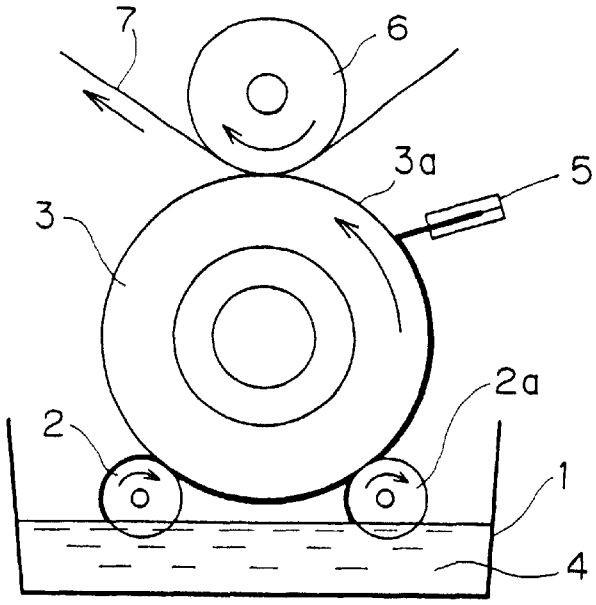
FIG. 9 is an explanatory view showing the sixth and the seventh embodiment of the present invention using aquatic gravure ink in which the furnisher roller is positioned both in the side of the doctor knife and in the opposite side against the doctor knife.

In FIG. 9, the reference numeral 1 indicates an ink pan filled with aquatic ink 4, and the ink 4 is pumped up and applied onto the surface 3*a* of the printing drum 3 by the furnisher roller 2 positioned in the opposite side to the doctor knife 5 and the furnisher roller 2*a* positioned in the side where the doctor knife 5 is provided. In FIG. 9, the reference numeral 6 indicates a pressure drum, and the reference numeral 7 indicates film (the printed element).

When the two furnisher rollers 2, 2*a* are positioned as shown in FIG. 9, at first the ink 4 is supplied by the furnisher roller 2 in the side opposite to the knife edge 5 to the printing drum 3, and then the ink 4 is supplied thereto by the furnisher roller 2*a,* so that the ink 4 is sufficiently applied onto the surface 3*a*. The ink does not drop (scatter) even when printing is performed at a high speed.

Experiment 1

In this Experiment 1, the furnisher roller unit shown in FIG. 9 was used. Printing was performed with a printing drum (with the depth of 13$\mu$ and 350 lines) prepared by applying the aquatic gravure ink (supplied by Toyo Ink Kabushiki Kaisha; product name: Aquaecol S; surface tension: 24 dyne/cm) onto bi-axial oriented PP film (with the thickness of 20$\mu$), and the printing speed could be raised up to 300 m/min without losing the good printing conditions.

In this experiment, the two furnisher rollers 2, 2*a* were provided in the side where the doctor knife 5 was positioned and also in the opposite side. Because of this configuration, the printing ink 4 did not drop into the ink pan 1 even when the printing drum was rotated at a high speed, and wetting failure on the printing plate surface 3*a* as an intrinsic defect of aquatic gravure ink did not occur.

Control 4

Figure 11:
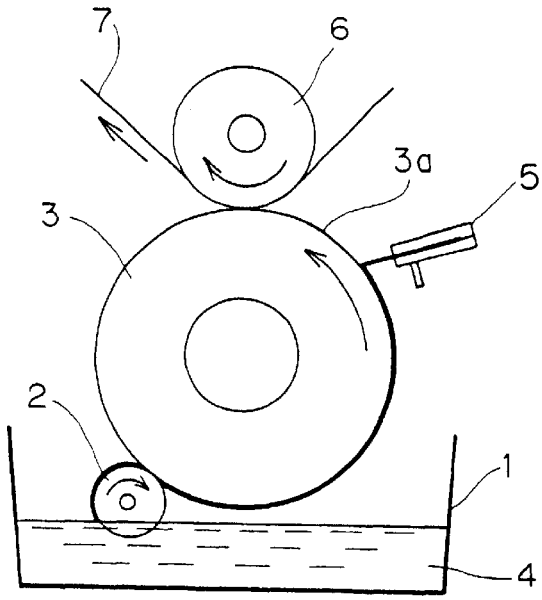
FIG. 11 is an explanatory view showing a position of the conventional type of furnisher roller.

The furnisher roller (based on the conventional technology) shown in FIG. 11 was used. Printing was performed under the same conditions as those in Experiment 1 above. The printing speed could be raised only up to 70 m/min without losing the good printing conditions.

The limited printing performance in this case is based on the fact that wetting failure occurs due to large surface tension of the aquatic gravure ink 4 itself and the ink 4 applied on the printing plate surface 3*a* drops into the ink pan 1 when the printing drum 3 is rotated at a higher speed.

Embodiment 7

An embodiment according to the invention is described in detail below.

Experiment 2

Printing was performed under the same conditions as those in Experiment 1 excluding the fact that oil gravure ink (supplied by Toyo Ink Kabushiki Kaisha; product name: NEW LP Super; surface tension: 17 dyne/cm) was used for the printing ink. As the result, even when the printing speed was raised up to 350 m/min, printing could be performed under good conditions.

Control 5

Printing was performed under the same conditions as those employed in Experiment 2 by using a printing machine in which the furnisher roller 2 was provided only in the opposite side to the knife edge 5 as shown in FIG. 11. In this case, the printing ink dropped with uneven printing generated when the printing speed was over 200 m/min, and printing could not be performed under good conditions.

Embodiment 8

Figure 10:
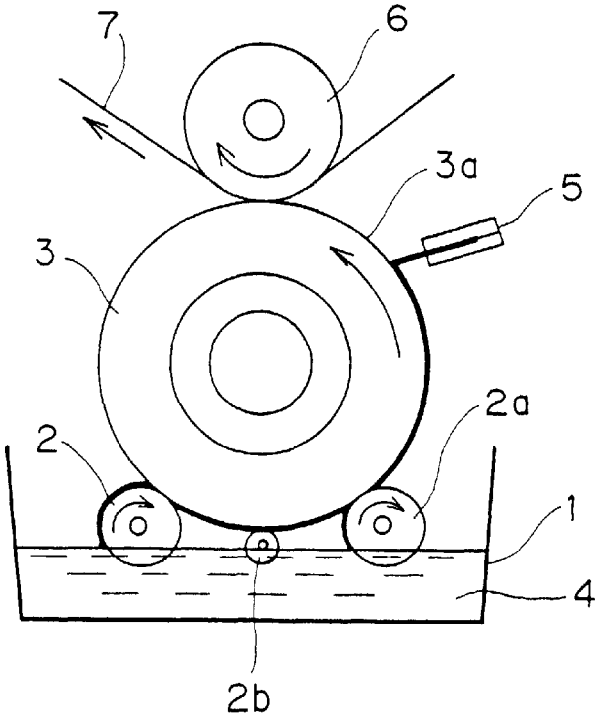
FIG. 10 is an explanatory view showing the eighth embodiment in which furnisher rollers are provided at three positions.

An embodiment of the present invention is shown in FIG. 10. In this embodiment, a third furnisher roller 2*b* is provided between the furnisher roller 2 and furnisher roller 2*a*. With this configuration, printing was performed under the same conditions as those employed in Experiment 1, and printing could be performed under good conditions. Further, even when the printing speed was raised up to 320 m/min, the printing ink did not drop, and printing was performed under good conditions.

Embodiment 9

Figure 12:
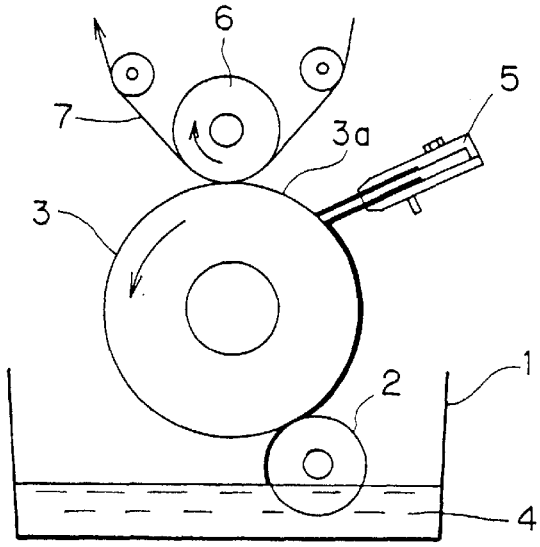
FIG. 12 is an explanatory view showing two blade tips of doctor knife according to the 9th embodiment of the present invention using aquatic gravure ink, configured so that generation of fogging on a surface of a printing plate due to doctor cutting fault is prevented.

An embodiment of the invention is described in detail below with reference to FIG. 12 and FIG. 13. This embodiment relates to the structure of a doctor knife unit according to the invention, and FIG. 12 is a side view of a key section of a gravure printing machine consisting of the printing drum 3, an ink pan 1 in which aquatic ink 4 is pooled, a furnisher roller 2 positioned in the side where a doctor knife 5 is provided for transferring and applying the aquatic ink 4 from the ink pan 1 onto the printing plate surface 3*a,* the doctor knife 5 for scraping off surplus ink from the printing plate surface 3*a* by contacting the two blade tips thereto, and a pressure drum 6 for pressing base film 7 to the printing plate surface 3*a*.

By providing the furnisher roller 2 in the side where the doctor knife 5 is positioned, there is provided the advantage that wetting failure can be prevented by reducing a quantity of dropping ink having been applied onto the printing plate surface 3*a* and also printing can be performed at a high speed.

Figure 13:
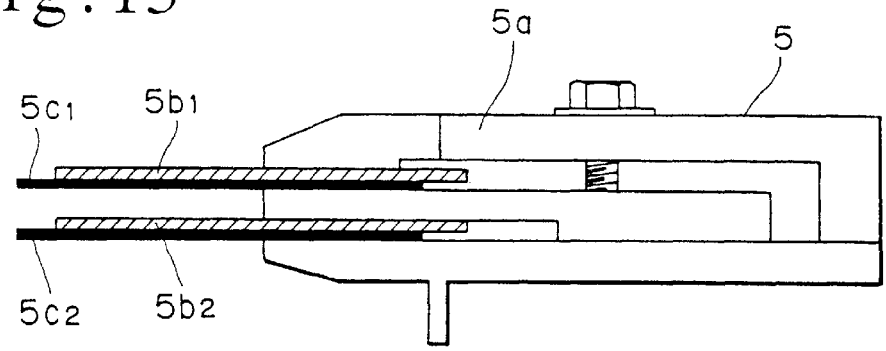
FIG. 13 is an explanatory view showing the doctor knife unit according to the 9th embodiment of the present invention.

The double-bladed doctor knife 5 has blade tips $\mathbf{5}c_1$ and $\mathbf{5}c_2$ supported by back plates $\mathbf{5}b_1$ and $\mathbf{5}b_2$ and fixed with the bracket 5*a* as shown in FIG. 13, but the structure is not limited to this one. For instance, a plurality of doctor knifes 5 each set with a discrete bracket may be provided.

A space between the blade tips $\mathbf{5}c_1$ and $\mathbf{5}c_2$ may be set to any value according to the necessity.

Further the length of each of the back plates $\mathbf{5}b_1$, $\mathbf{5}b_2$ projecting from the bracket 5*a* and blade tips $\mathbf{5}c_1$, $\mathbf{5}c_2$ may be set to any value according to the necessity discretely.

The doctor knife 5 used in this embodiment is a double-bladed one as shown in FIG. 12, and the lengths of the back plates $\mathbf{5}b_1$, $\mathbf{5}b_2$ projecting from the bracket 5*a* as shown in FIG. 13 are 26 m/m and 25 m/m respectively, while the length of both the blade tips $\mathbf{5}c_1$, $\mathbf{5}c_2$ projecting from the back plates $\mathbf{5}b_1$, $\mathbf{5}b_2$ is 3.5 m/m, and a space between the blade tips $\mathbf{5}c_1$, $\mathbf{5}c_2$ is 0.8 m/m.

By using the bi-axial oriented polypropylene film 20$\mu$ as a base material, a printing plate with 350 lines and the depth of 13$\mu$ was prepared by a laser system, and printing with six colors was performed by using aquatic gravure ink available from the market and five printing plates for indigo blue, red, yellow, black, and white colors.

In this case, the printing ink on the printing plate surface 3*a* was scraped off by the first blade tip $\mathbf{5}c_2$ first and then by the second blade tip $\mathbf{5}c_1$ from the printing plate surface 3*a,* and printing could be performed under good conditions without generation of doctor cutting fault.

The number of doctor knifes 5 used is practically limited to three units. The two or three blades may be provided at a position or at different positions discretely. The conventional type of doctor knife 5 is generally made from stainless steel, and the configuration is allowable in which the first blade is made from stainless steel and the second one is made from other material.

The pressures loaded by the first and second knifes may be identical, or the pressure loaded by the first knife may be set to a higher pressure with that loaded by the second knife set to a lower pressure so that scraping by the second blade is performed like wiping off the ink.

Control 6

A control in which printing was performed with the doctor knife 5 shown in FIG. 14 and FIG. 15 using aquatic gravure ink is described below.

Figure 14:
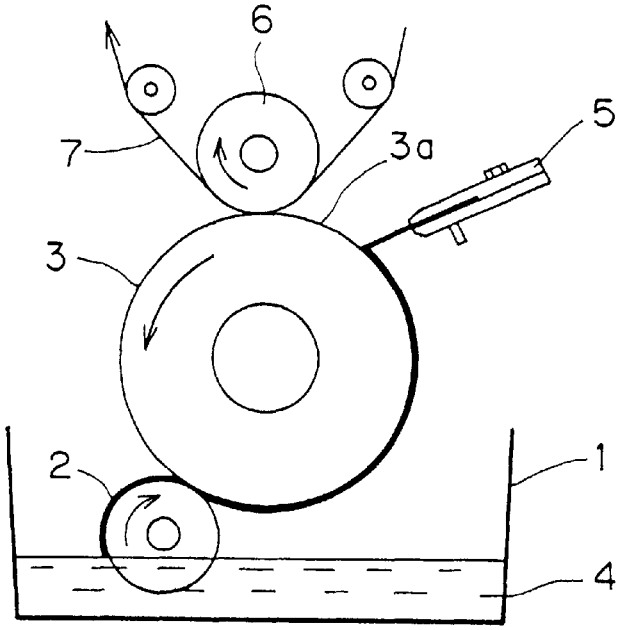
FIG. 14 is an explanatory view showing a key section of and a doctor in the conventional type of gravure printing machine using oil gravure ink.
Figure 15:
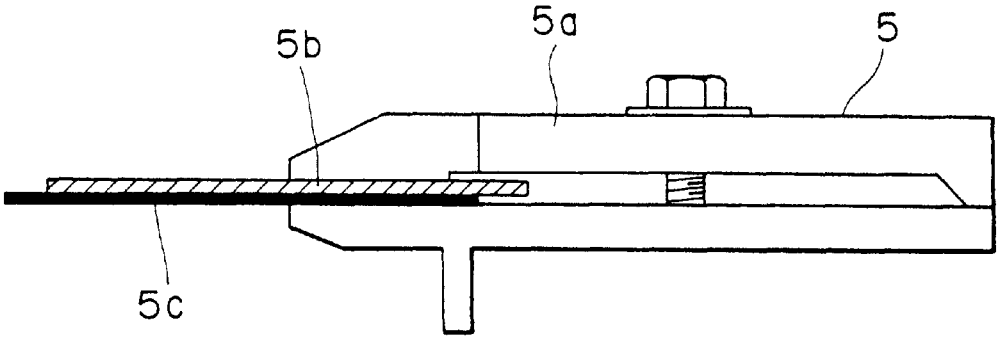
FIG. 15 is an explanatory view showing the conventional type of doctor knife unit.

This doctor knife 5 in this case has one blade like in the conventional type of doctor knife as shown in FIG. 14, and in FIG. 15, the length of the back plate 5*b* projecting from the bracket 5*a* is 25 m/m, and the length of the blade tip 5*c* projecting from the back plate 5*b* is 3.5 m/m.

Dimensions and construction of this doctor knife 5 are the same as those of the first doctor knife in Embodiment 9. With this doctor knife 5, printing was performed by using the same base film, printing plates, and aquatic gravure ink as those in the Embodiment.

The results of comparison are as shown in Table 1.

TABLE 1

| | Embodiments | Controls |
|---|---|---|
| Fogging on a printing plate | Fogging was not generated for any color even when printing was performed up to 20,000 m. Printing could be continued for a twice or more longer period of time as compared to that in the control. | Fogging occurred when printing was performed up to 10,000 m. Especially fogging occurred frequently in the cases of black ink (including carbon therein) and white ink (including titanium white). |
| Abrasion of doctor knife | As the doctor pressure was reduced to 1.5 kg, printing could be performed even up to 24,000 m continuously. | As the doctor knife had only one blade, the doctor pressure was set to 2 kg, and printing came to the limit at the length of 12,000 m. |
| Wearing of a printing plate | For the same reason as described above, printing could be performed up to 100,000 m or more continuously. | Printing reached a limit at the length of 70,000 m due to the same cause. |
| Printing speed | Printing could be performed even at the printing speed of 150 m/min. | Printing reached a limit at the printing speed of 120 m/min. |

As described above, according to one aspect of the invention of claims 1 to 5, by taking necessary measures in gravure cylinder making process to enable use of gravure printing technology using aquatic gravure ink for practical purposes, it is possible to obtain prints with the same quality as that realized by using the conventional oil ink. Namely, by using a printing plate with a number of lines and the small engraving depth, it is possible to solve the problems concerning quality of printed matters and productivity as that concerning gradation in printing caused in association with drying failure as an intrinsic defect of aquatic ink or fogging on a printing plate due to the hardness of aquatic ink in resolving in a water solvent or wetting failure of a surface of the printing plate.

Further by using aquatic gravure ink, it is possible to solve the labor problems in printing firms, those concerning accident prevention, those for prevention of environmental pollution due to emission of organic solvent vapor to the atmosphere, those concerning remaining solvents in food-packaging film. For the reasons as described above, the present invention provides large merits, for instance, in the food packaging industries using plastic films as base materials.

With the invention a quantity of ink pooled in an ink pan can be minimized, a quantity of ink remaining on an ink pan can be reduced from about 20 kg/pan in the conventional technology to about 5 kg/pan. As a result, it is possible to reduce the ink cost and the cost for stocking remaining ink, and also to save resources.

With a feature of the invention, printing ink is applied from a furnisher roller at a position where the printing plate surface is moving (rotating) upward, so that the printing ink does not scatter during high speed printing and further the problem of wetting failure does not occur, even if aquatic gravure ink with high surface tension is used.

With a feature of the invention, the contact pressure of a doctor knife tip to a printing plate surface is optimized in gravure printing performed by using aquatic ink, and fogging does not occur on the printing plate surface.

With features of the invention, furnisher rollers are provided both in the side opposite to the knife edge and in the side where the knife edge is positioned, and in addition, when required, between the two sides, printing ink is sufficiently applied to a surface of a printing plate, and wetting failure does not occur even when aquatic gravure ink with high surface tension is used, so that high quality printed matters can be obtained without causing blurring or fogging.

For the reasons described above, with the present invention, printing can be performed with aquatic gravure ink to evade environmental pollution. Further when oil gravure ink is used, the printing speed can be increased.

With features of the invention, a plurality of doctor knives for aquatic gravure printing machine are provided, so that the doctor knives well function to scrape off surplus ink from the printing plate surface, so that high-quality prints can be obtained, even when aquatic printing ink having high surface tension and the hardness in resolving in a water solvent as intrinsic defects thereof is used, without causing blurring or fogging on the printing plate.

Further, as the doctor pressure can be set to a low level, abrasion of the doctor knife and wearing of the printing plate can be reduced, so that not only the printing speed can be raised but also the productivity can be improved.

While specific embodiments of the invention have been shown and described in detail to illustrate the application of the principles of the invention, it will be understood that the invention may be embodied otherwise without departing from such principles.

What is claimed is:

1. An ink pan gravure printing machine arrangement using aquatic or oil gravure ink, the arrangement comprising:

a furnisher roller;

a printing drum; and an ink pool having the size big enough for said furnisher roller, said furnisher roller dipping into said ink pool with said printing drum being maintained outside of said ink pool;

a doctor blade acting on said printing drum in an operative state wherein a length L of back plates of said doctor blade, projecting from a bracket of said doctor blade is set in the range from 20 m/m to 30 m/m and the length L1 of a blade of the doctor blade projecting from the back plate is set to 3 m/m to 4 m/m.

2. An ink pan gravure printing machine arrangement according to claim 1, wherein:

said furnisher roll is provided on a side where said doctor blade is positioned.

3. An ink pan gravure printing machine arrangement according to claim 1, further comprising another furnisher roller.

4. An ink pan gravure printing machine arrangement according to claim 3, wherein the furnisher rolls are provided both in the side opposite to the doctor knife and in the side where the doctor knife is positioned.

5. An ink pan gravure printing machine arrangement according to claim 3, wherein a single or a plurality of furnisher rolls are provided between the doctor knife and the furnisher roll positioned in the opposite side.

6. An ink pan gravure printing machine arrangement according to claim 3, wherein printing is performed using aquatic gravure ink.

7. An ink pan gravure printing machine arrangement according to claim 3, wherein printing is performed using using oil gravure ink.

8. An ink pan gravure printing machine arrangement according to claim 1, further comprising another doctor blade.

9. An ink pan gravure printing machine arrangement according to claim 8, wherein said doctor blade is positioned before the printing drum and said another doctor blade is positioned behind the printing drum, wherein a blade pressure of said doctor blade and said another doctor blade contacting said printing drum are set so that the pressure applied by said doctor blade is equal to or larger than a pressure applied by said another doctor blade.

10. An ink pan gravure printing machine arrangement according to claim 9, wherein a material of said doctor blade positioned before the printing drum is different from a material of said another doctor blade positioned behind the printing drum.

11. An ink pan gravure printing machine arrangement according to claim 1, wherein:

a majority of said printing drum is horizontally spaced from said ink pool.

12. An ink pan gravure printing machine arrangement according to claim 1, further comprising:

an ink pan having a deep section holding said ink pool, said ink pan having a shallow section arranged under said printing drum and guiding ink falling from said printing drum into said ink pool.

* * * * *